US009175932B2

(12) United States Patent
Haynes et al.

(10) Patent No.: US 9,175,932 B2
(45) Date of Patent: Nov. 3, 2015

(54) METHOD FOR ANALYZING AND DESIGNING ARMOR IN A VEHICLE

(75) Inventors: David F. Haynes, Arlington, TX (US); William D. Girard, Euless, TX (US); Kendall E. Goodman, Southlake, TX (US); Kelly R. Tingen, Coppell, TX (US)

(73) Assignee: Textron Innovations Inc., Providence, RI (US)

( * ) Notice: Subject to any disclaimer, the term of this patent is extended or adjusted under 35 U.S.C. 154(b) by 327 days.

(21) Appl. No.: 13/266,702

(22) PCT Filed: May 5, 2010

(86) PCT No.: PCT/US2010/033758

§ 371 (c)(1),
(2), (4) Date: Oct. 27, 2011

(87) PCT Pub. No.: WO2010/129696

PCT Pub. Date: Nov. 11, 2010

(65) Prior Publication Data

US 2012/0041724 A1 Feb. 16, 2012

Related U.S. Application Data

(60) Provisional application No. 61/175,598, filed on May 5, 2009.

(51) Int. Cl.

| | |
|---|---|
| ***G06F 17/50*** | (2006.01) |
| ***F41H 7/02*** | (2006.01) |
| ***F41H 7/04*** | (2006.01) |

(52) U.S. Cl.

CPC ... *F41H 7/02* (2013.01); *F41H 7/04* (2013.01)

(58) Field of Classification Search

None

See application file for complete search history.

(56) References Cited

U.S. PATENT DOCUMENTS

| | | | | |
|---|---|---|---|---|
| 6,047,781 | A * | 4/2000 | Scott et al. | 175/5 |
| 6,523,450 | B1 | 2/2003 | Schreiber | |
| 6,763,898 | B1 * | 7/2004 | Roodenburg et al. | 175/7 |
| 7,140,453 | B2 * | 11/2006 | Ayling | 175/52 |
| 7,225,717 | B2 | 6/2007 | Williams | |

(Continued)

FOREIGN PATENT DOCUMENTS

WO WO2007/005043 A2 1/2007

OTHER PUBLICATIONS

Celmins Accuracy of Vulnerability Integrals U.S. Army Laboratory Command, Technical Report BRL-TR-3084, Apr. 1990.*

(Continued)

*Primary Examiner* — Omar Fernandez Rivas
*Assistant Examiner* — Cuong Luu
(74) *Attorney, Agent, or Firm* — James E. Walton; Brian E. Harris

(57) ABSTRACT

Properly identifying the most vulnerable areas and quantifying the effectiveness of armor at those locations is critical to achieving efficient armor integration. A method for designing protective armor for a vehicle includes the deriving shotlines through an element; computing a probability of kill value for each shotline in each element; calculating a probability of kill intensity for each element; ranking the elements according to highest probability of kill intensity; mapping the elements in a 3D CAD environment to visually depict the elements having the highest probability of kill intensity; and designing armor taking into account the elements having the highest probability of kill intensity.

17 Claims, 6 Drawing Sheets

(56) References Cited

U.S. PATENT DOCUMENTS

| | | | | |
|---|---|---|---|---|
| 2005/0051072 | A1* | 3/2005 | Roodenburg et al. | 114/201 R |
| 2007/0028759 | A1 | 2/2007 | Williams | |
| 2009/0136327 | A1* | 5/2009 | Often et al. | 414/22.55 |
| 2009/0196712 | A1* | 8/2009 | Mortensen et al. | 414/22.68 |
| 2011/0120293 | A1* | 5/2011 | Venton-Walters et al. | 89/36.02 |

OTHER PUBLICATIONS eitz et al. Synthesized CAD Methods for Combat Vehicle Survivability Analysis U.S. Army Laboratory Command, Memorandum Report BRL-MR-3883, Dec. 1990.*

Haskell AVVAM-1 and Tank Vulnerability Sensitivity Studies Conference paper, 1973.*

Dotterweich A Stochastic Approach to Vulnerability Assessment Technical Report ARBRL-TR-02578, Jul. 1984.*

Stuart Arnold, Russell Hardy ADA038755 Secondary Damage to Aircraft by Ricocheted Smal Arms Projectiles and Fragments Army Materials and Mechanics Research Center, Nov. 1976.*

I.V. Roisman, K. Weber, A.L. Yarin, V. Hohler, M.B. Rubin Oblique Penetration of a Rigid Projectile into a Thick Elastic-Plastic Target: Theory and Experiment Internaltional Journal of Impact Engineering 22, 1999, pp. 707-726.*

Celmins Accuracy of Vulnerability Integrals, U.S. Army Laboratory Command Technical Report BRL-TR-3084, Apr. 1990.*

Of Deitz et al. Synthesized CAD Methods for Combat Vehicle Survivability Analysis, U.S. Army Laboratory Command, Memorandum Report BRL-MR-3883, Dec. 1990.*

Arnold et al. ADA038755, Second Damage to Aircraft by Ricocheted Small Arms Projectiles and Fragments Nov. 1976.*

Chu et al. The Study of Obliquity on the Ballistic Performance of Basket Fabric Composite Materials, Journal of Composite Materials, vol. 41, No. 13, 2007.*

International Search Report and the Written Opinion of the International Searching Authority mailed by ISA/USA, U.S. Patent and Trademark Office on Jul. 16, 2010 for International Patent Application No. PCT/US10/33758, 7 pages.

International Preliminary Report on Patentability of the International Examining Authority mailed by IPEA/US, U.S. Patent and Trademark Office on Jul. 15, 2011 for International Patent Application No. PCT/US10/33758, 4 pages.

Baker, William E. et al., Vulnerability/Lethality Modeling of Armored Combat Vehicles—Status and Recommendations. Army Research Laboratory, Feb. 1993, AD-A261691, 70 pages.

Deitz, Paul H. et al, Synthesized CAD Methods for Combat Vehicle Survivability Analysis, U.S. Army Laboratory Command, Ballistic Research Laboratory, Dec. 1990, AD-A234-077, 76 pages.

Extended European Search Report from the European Patent Office in related European Application No. 10772782, mailed Nov. 21, 2012, 7 pages.

European examination report in related European patent application No. 10772782.8, 5 pages, mailed Mar. 7, 2014.

* cited by examiner

| SHOT # | Data from COVART | | | | | Shot Line in Airframe Coordinates | | | | | |
|---|---|---|---|---|---|---|---|---|---|---|---|
| | x | z | az | el | pk | xs | ys | zs | xe | ye | ze |
| 1 | 46.5 | 71.5 | 40 | 10 | 1 | 19.23 | 49.42 | 68.11 | -44.07 | 124.86 | 50.74 |
| 2 | 46.5 | 65.5 | 40 | 0 | 1 | 18.52 | 50.27 | 65.50 | -45.76 | 126.87 | 65.50 |
| 3 | 46.5 | 57.5 | 40 | -10 | 1 | 18.24 | 50.60 | 63.15 | -45.06 | 126.04 | 80.52 |
| 4 | 46.5 | 47.5 | 40 | -20 | 1 | 18.32 | 50.50 | 60.34 | -42.08 | 122.49 | 94.55 |
| 5 | 46.5 | 11.5 | 40 | -50 | 0.5 | 19.44 | 49.17 | 47.89 | -21.88 | 98.41 | 124.49 |
| Shots 6-40 not shown | | | | | | | | | | | |
| 39 | 47.5 | 71.5 | 120 | -10 | 0.5 | 61.27 | 90.23 | 55.29 | -24.01 | 40.98 | 72.66 |
| 40 | 47.5 | 74.5 | 120 | -20 | 0.5 | 57.76 | 88.20 | 45.02 | -23.62 | 41.21 | 79.23 |
| 41 | 31.5 | 55.5 | 140 | 10 | 0.5 | 56.78 | 116.67 | 78.55 | -6.53 | 41.23 | 61.19 |
| 42 | 31.5 | 65.5 | 140 | 0 | 0.5 | 57.25 | 117.23 | 65.50 | -7.03 | 40.63 | 65.50 |
| 43 | 31.5 | 73.5 | 140 | -10 | 0.5 | 55.79 | 115.49 | 52.71 | -7.52 | 40.05 | 70.08 |
| | | | | Sum Pk values= | 28 | | | | | | |

117

| | 0.5 | 0.0 | 0.0 | 1.0 | 1.0 | 0.0 | | | | |
|---|---|---|---|---|---|---|---|---|---|---|
| | 2714.5 | 49.0 | 1.0 | 604 | 2 | 79.8 | CUMMULATIVE TOTAL | | CUMMULATIVE TOTAL NORM. | |
| Area | Σ Pk | Σ Pk/A | Σ Pk/A norm | ElemID | BodyID | Obliq min | AREA | Pk | AREA | Pk |
| 0.7645 | 24.0 | 31.394 | 0.640081 | 90 | 2 | 10.07978 | 0.76 | 24.00 | 0.0016 | 0.0052 |
| 0.7648 | 22.0 | 28.765 | 0.586492 | 48 | 2 | 1.342176 | 1.53 | 46.00 | 0.0031 | 0.0099 |
| 0.8802 | 23.9 | 27.153 | 0.553627 | 63 | 2 | 1.778147 | 2.41 | 69.90 | 0.0049 | 0.0150 |
| 0.8962 | 24.3 | 27.114 | 0.552834 | 64 | 2 | 1.830991 | 3.31 | 94.20 | 0.0067 | 0.0203 |
| 0.7655 | 20.1 | 26.256 | 0.535338 | 342 | 2 | 20.0166 | 4.07 | 114.30 | 0.0083 | 0.0246 |
| 0.7658 | 19.7 | 25.724 | 0.524494 | 258 | 2 | 14.54618 | 4.84 | 134.00 | 0.0099 | 0.0288 |
| 0.7655 | 19.5 | 25.473 | 0.519367 | 174 | 2 | 14.70533 | 5.60 | 153.50 | 0.0114 | 0.0330 |
| 0.7646 | 19.3 | 25.242 | 0.514652 | 216 | 2 | 14.66267 | 6.37 | 172.80 | 0.0130 | 0.0372 |
| 0.7651 | 18.8 | 24.573 | 0.501018 | 132 | 2 | 10.09124 | 7.13 | 191.60 | 0.0145 | 0.0412 |
| 0.8305 | 20.2 | 24.321 | 0.495885 | 56 | 2 | 1.614263 | 7.96 | 211.80 | 0.0162 | 0.0456 |
| Remaining elements this range not shown | | | | | | | | | | |
| 1.0600 | | 0.000 | 0 | 127 | 2 | | 480.57 | 4647.00 | 0.9803 | 1.0000 |
| 1.0763 | | 0.000 | 0 | 128 | 2 | | 481.64 | 4647.00 | 0.9825 | 1.0000 |
| 1.0772 | | 0.000 | 0 | 129 | 2 | | 482.72 | 4647.00 | 0.9847 | 1.0000 |
| 1.0937 | | 0.000 | 0 | 130 | 2 | | 483.81 | 4647.00 | 0.9869 | 1.0000 |
| 1.0440 | | 0.000 | 0 | 166 | 2 | | 484.86 | 4647.00 | 0.9891 | 1.0000 |
| 1.0606 | | 0.000 | 0 | 168 | 2 | | 485.92 | 4647.00 | 0.9912 | 1.0000 |
| 1.0601 | | 0.000 | 0 | 169 | 2 | | 486.98 | 4647.00 | 0.9934 | 1.0000 |
| 1.0764 | | 0.000 | 0 | 170 | 2 | | 488.05 | 4647.00 | 0.9956 | 1.0000 |
| 1.0772 | | 0.000 | 0 | 171 | 2 | | 489.13 | 4647.00 | 0.9978 | 1.0000 |
| 1.0936 | | 0.000 | 0 | 172 | 2 | | 490.23 | 4647.00 | 1.0000 | 1.0000 |

119

METHOD FOR ANALYZING AND DESIGNING ARMOR IN A VEHICLE

TECHNICAL FIELD

The present application relates to vehicle armor analysis and design. In particular, the present application relates to methods for analyzing and designing armor in a vehicle, such as a helicopter.

DESCRIPTION OF THE PRIOR ART

Armor placement and geometry has been developed using basic design guidelines and principles. Prior art methods of designing armor in a vehicle include an approach of defining, modeling, and then evaluating the armor design. Such a method seldom provides an optimal design solution. Further refinement of the armor design for an improved design efficiency required evaluation of multiple configurations or variations, the number of which being limited due to the extensive modeling and analysis resources needed. Such an iterative process limits the degree of optimization possible, and a more direct approach for defining and evaluating armor effectiveness is needed.

Hence, there is a need for an improved method for analyzing and designing armor in a vehicle.

BRIEF DESCRIPTION OF THE DRAWINGS

The novel features believed characteristic of the method of the present application are set forth in the appended claims. However, the method itself, as well as a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1:
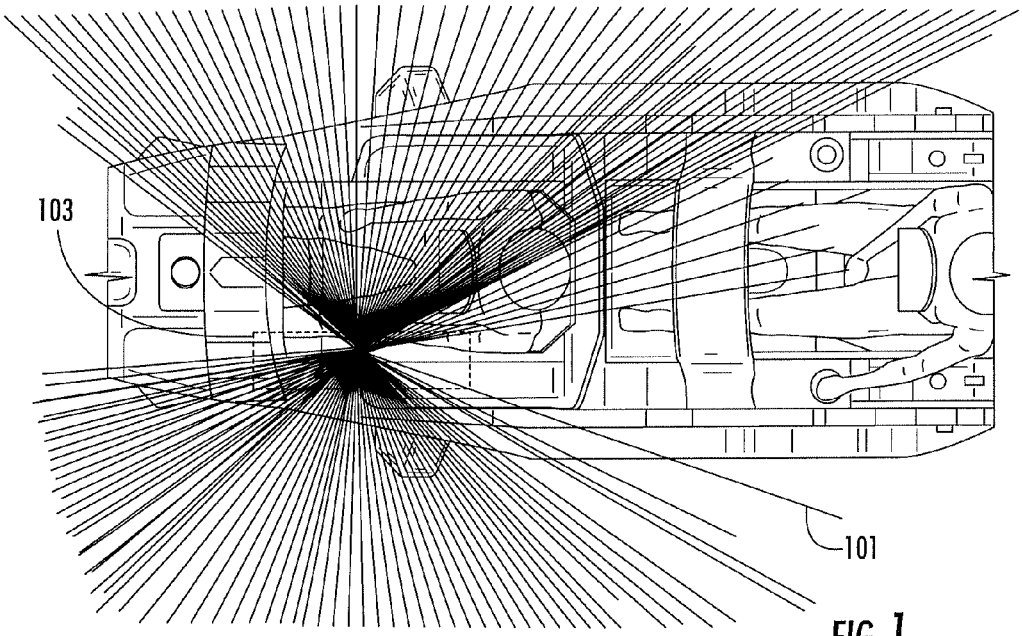
FIG. 1 shows a plan view of shotlines penetrating an air vehicle airframe.

While the method of the present application is susceptible to various modifications and alternative forms, specific embodiments thereof have been shown by way of example in the drawings and are herein described in detail. It should be understood, however, that the description herein of specific embodiments is not intended to limit the method to the particular forms disclosed, but on the contrary, the intention is to cover all modifications, equivalents, and alternatives falling within the spirit and scope of the application as defined by the appended claims.

DESCRIPTION OF THE PREFERRED EMBODIMENT

Illustrative embodiments of the method of the present application are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Properly identifying the most vulnerable areas and quantifying the effectiveness of armor at those locations is critical to achieving efficient armor integration. As mentioned, prior art practices involve a basic trial and error approach where potential configurations are defined, modeled, and evaluated, with final geometry derived from these results. This seldom provides an optimum design, and can lead to ineffective systems if initial assumptions for where armor is needed are wrong.

The method of the present application provides new methods and analysis products developed to help overcome deficiencies with legacy armor design practice. A technical description of core functions and mathematic operations is discussed to facilitate their integration of this capability into the next generation analysis and design systems.

In the present application, a helicopter fuselage is used as an exemplary platform for using the methods of analyzing and developing armor according to the present application. It should be appreciated that vehicles, other than helicopters, may equally benefit from the methods disclosed herein. For example, vehicles may include other flying vehicles, such as airplanes and tiltrotors, as well as land based vehicles, such as tanks and jeeps, to name a few. Furthermore, the methods disclosed herein are depicted for developing armor for the protection of a human pilot; however the methods of the present application are not so limited. For example, the present methods may be used to develop armor for protection of other human vehicle occupants, such as crew members and passengers. The armor may also be developed to protect non-human parts of vehicles, such as flight critical components. An example of a flight critical component may be an engine component or flight control system. As such, it should be appreciated that the methods disclosed in the present application are applicable to strategically analyzing and designing armor in a wide variety of applications.

Figure 12:
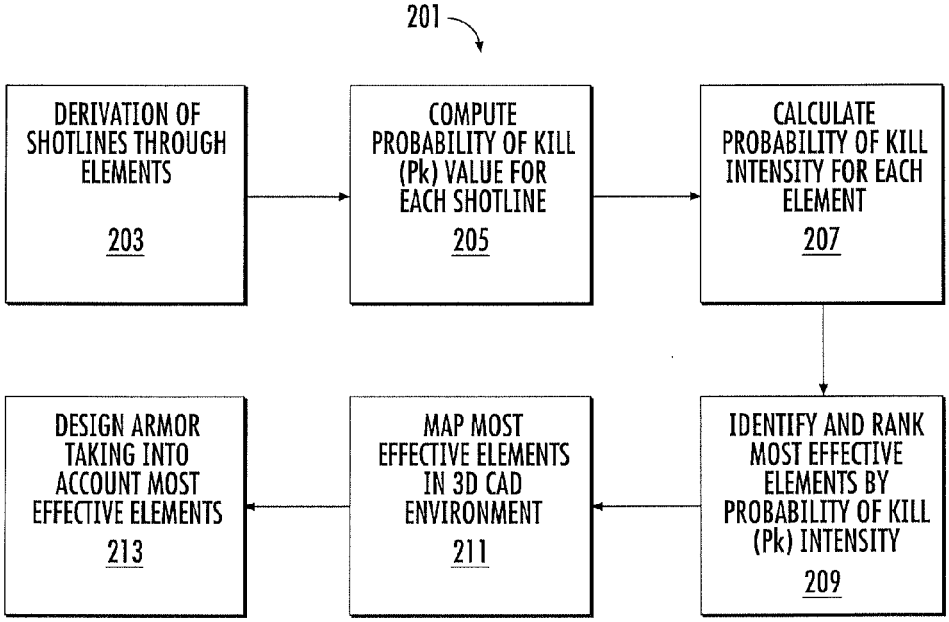
FIG. 12 shows a schematic view of the preferred method for analyzing and designing armor according to the present application.

Referring briefly to FIG. 12, a method 201 for designing protective armor for a vehicle according to the preferred embodiment is shown in schematic form. A step 203 comprises deriving shotlines through at least one element so as to facilitate the analysis. Next, a step 205 involves computing a probability of kill (Pk) value for each shotline. A step 207 comprises calculating the probability of kill (Pk) intensity for each element. A step 209 comprises identifying and ranking the most effective elements by their probability of kill intensity. A step 211 comprises mapping the most effective elements in a 3D CAD environment. A step 213 comprises designing the armor while taking into account the most effective elements.

Referring now to FIG. 1, step 203 of method 201 is exemplified. Step 203 involves quantifying where and how many shots are penetrating various locations in the airframe. Some areas will have a greater number than others, depending in part according to structure of the vehicle. The areas have a high number of shot penetrations are where armor should be placed to be the most effective. A dataset of shotlines 101, or shot trajectories, penetrating the airframe are generated. When bounded areas within the airframe or system are defined, the actual shots passing through these areas are identified and counted. This facilitates a shots per square inch calculation that provides a direct indication of the vulnerability of these areas, and also effectiveness of armor. By defining these areas mathematically, the dimensions can be small enough so as to achieve a high degree of resolution.

Still referring to FIG. 1, a tool for generating shotlines 101, such as COVART (Computation of Vulnerable Area Tool) may be used to derive the necessary shotlines 101 to facilitate analysis. COVART calculates shotlines 101 taking into account airframe structure and the vulnerability of shot exposure to the pilot. In addition, COVART calculates a probability of kill (Pk) value between 0 and 1 for each shotline 101, which can be used to weigh the shots per square inch value. The probability of kill (Pk) value takes into account lethality such that shotlines which may produce a higher lethality are given a higher Pk value. Step 205 of method 201 involves computing the Pk value for each shotline 101. Summing the Pk values for shots passing through an area, rather than just counting the total number of shots, provides a better indication of how beneficial armor might be at that location. If we divide this sum by the area we define the following:

$$\text{Pk Intensity} = \text{Sum of Pk values/area} \quad (1)$$

Step 207 of method 201 involves calculating the Pk Intensity for each element. The Pk Intensity is a very useful value for the analyst or designer. Armor is heavy, so limited coverage and strategic placement is critical. Biasing the placement where the Pk Intensity is higher will provide greater benefit overall for a given amount of added weight. For example, consider the application of new armor for enhanced crew protection for the air vehicle shown in FIG. 1. A potential armor mounting location is identified between the gunner and LBL 10.00 main structural beam, and we would like to know in general how effective a vertical plate of armor might be. As expected, numerous penetrations are possible through the airframe at this location, which are indicated by the COVART derived shotlines 101 plotted in FIG. 1.

Figure 2:
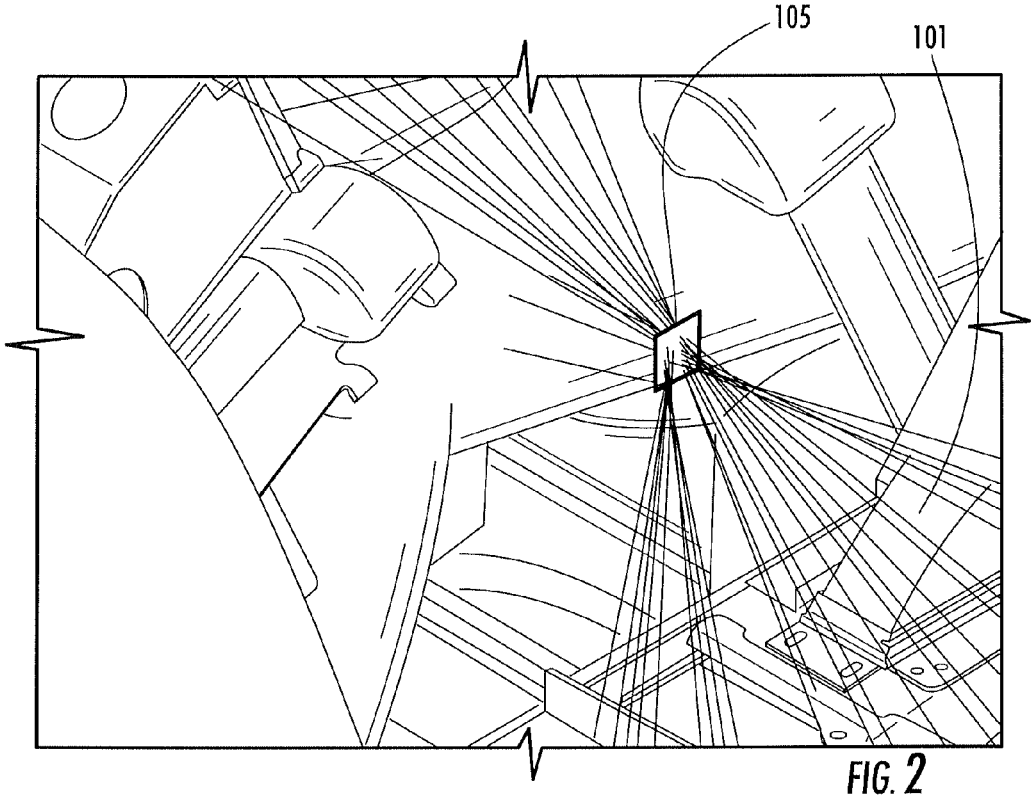
FIG. 2 shows an isometric view of shotlines penetrating a single element.
Figures 3, 4:
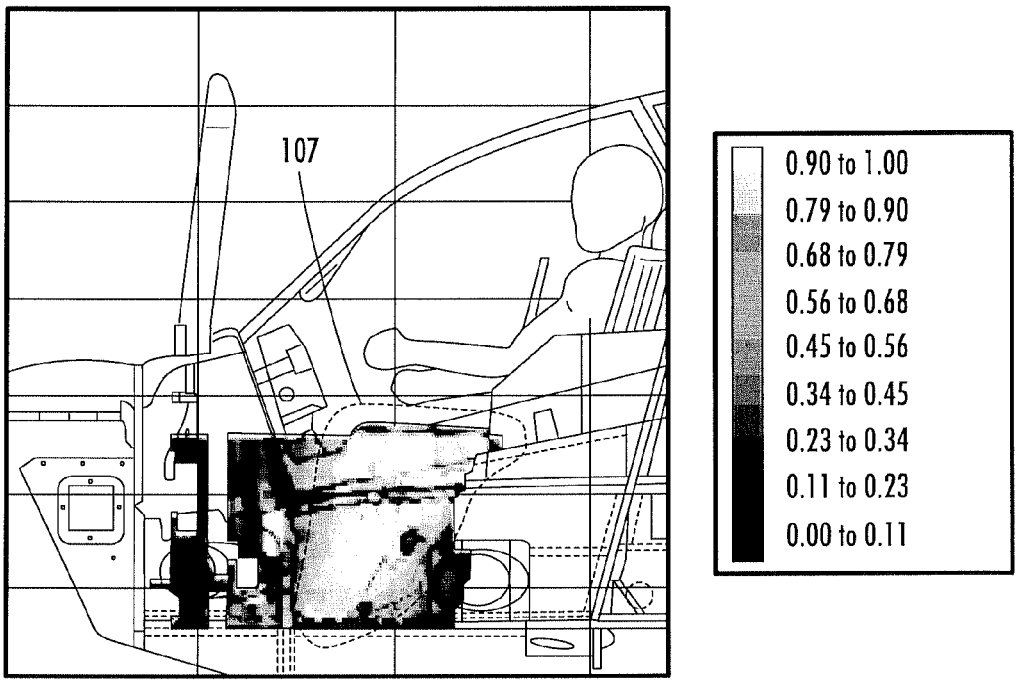
FIG. 3 shows a table with data for summing probability of kill (Pk) values for each shotline.
FIG. 4 shows a side view of probability of kill (Pk) intensities on an air vehicle airframe.

Referring now also to FIGS. 2 and 3, determining the effectiveness of armor in the location of interest, the region of interest outlined by dashed box 103 is mathematically modeled as a plurality 1" by 1" squares, such as element 105. The intersecting shotlines and corresponding Pk intensity are determined. It should be appreciated that the region may be mathematically model as elements sized larger or smaller than 1" by 1", or even as shapes other than squares. For the interest of clarity only a single element 105 is shown. For the particular element 105 in this example, 43 shotlines are found to intersect, and the sum of their individual Pk values is 28, as shown in FIG. 3. Since the area of element 105 is 1 square inch, the Pk Intensity value for element 105 is 28. To complete the analysis of this region, the process is repeated for all remaining elements, and their normalized Pk Intensity values are then plotted, as shown in FIG. 4.

Referring to FIG. 4, each element 105 is shown with shading and mapped in a 3D CAD (Computer Aided Design) environment, in accordance with step 211 of method 201. The lighter shading represents elements 105 having higher Pk Intensity values. In contrast, darker shading represents elements 105 having lower Pk Intensity values. It should also be appreciated that a color spectrum may be used instead of grayscale shading in order to represent Pk Intensities. For example, a red color may represent a high Pk Intensity, while a blue color may represent a low Pk intensity.

Still referring to FIG. 4, step 213 involves designing armor while taking into account the most effective elements 105. For example, dashed curve 107 represents an outlining of the areas of higher element intensities, which provides the designer a potentially efficient armor shape. If this is extended to include more of the lower intensity areas, little added protection would be gained at the expense of added weight. This outlining of effective areas can be done mathematically to provide specific armor geometry for various levels of added protection. This will be discussed more thoroughly later.

The Pk Intensity calculation can be applied to any surface for which a bounded area can be defined and for which intersecting shotlines 101 can be determined. With the previous example, the region of interest lies on a principal plane at LBL 10.0, from which smaller bounded planer areas 105 could be easily defined mathematically and the calculations performed. For more complex geometry, the surfaces and boundaries are of a higher order mathematical description and are more complex and difficult to evaluate. However, these can be modeled as faceted or meshed regions, for which the resulting planer areas are more easily evaluated.

Figure 5:
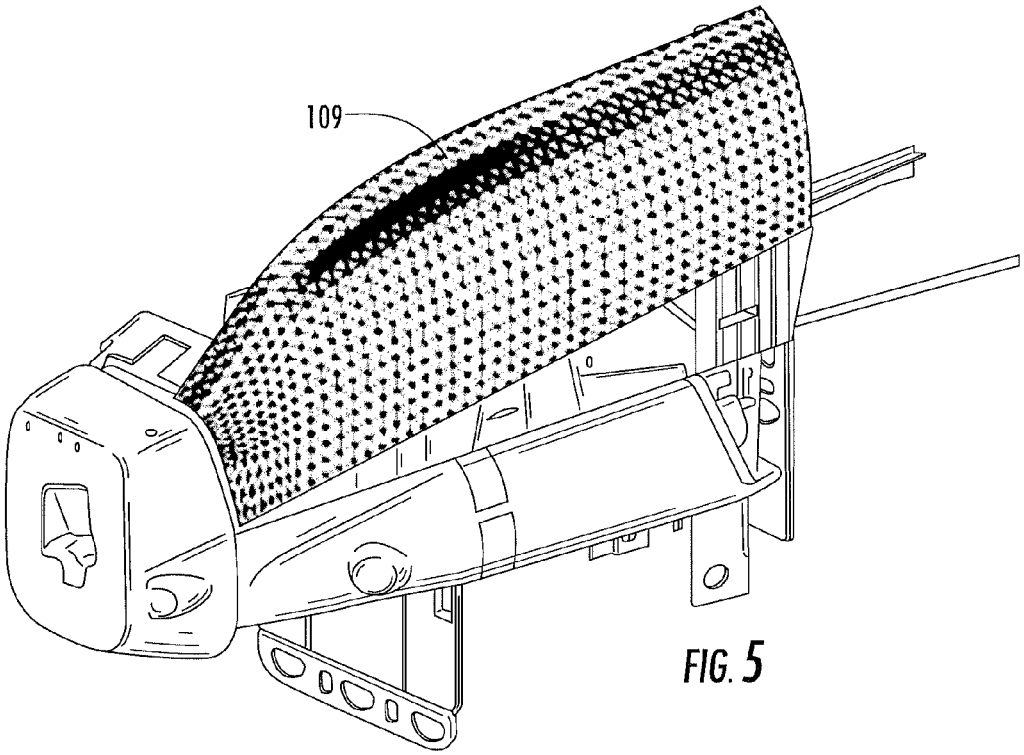
FIG. 5 shows an isometric view of a tetrahedral mesh of an air vehicle canopy.

For example, consider the air vehicle canopy shown in FIG. 5. This complex geometry is comprised of multiple CAD defined surfaces and curved boundaries, but can be approximated quite well as a tetrahedral mesh. A tetrahedral mesh of a complex surface is shown in FIG. 5. Each triangular element 109 defines a bounded planar area similar to planar element 105 shown in FIG. 2. Intersecting shotlines 101 and Pk intensity can be determined using similar mathematical operations as was used and describe regarding FIGS. 1 through 4, and 12. Although this requires additional modeling and computation time, several benefits are realized. First, the analyst can use existing CAD geometry to model and mesh complex geometry or regions of interest, so is not burdened with the potentially complex task of defining these mathematically. Second, the calculated Pk intensities can be color mapped or shaded to their corresponding mesh elements and overlaid back onto and the original defining CAD geometry, which is shown in FIG. 6.

Figure 6:
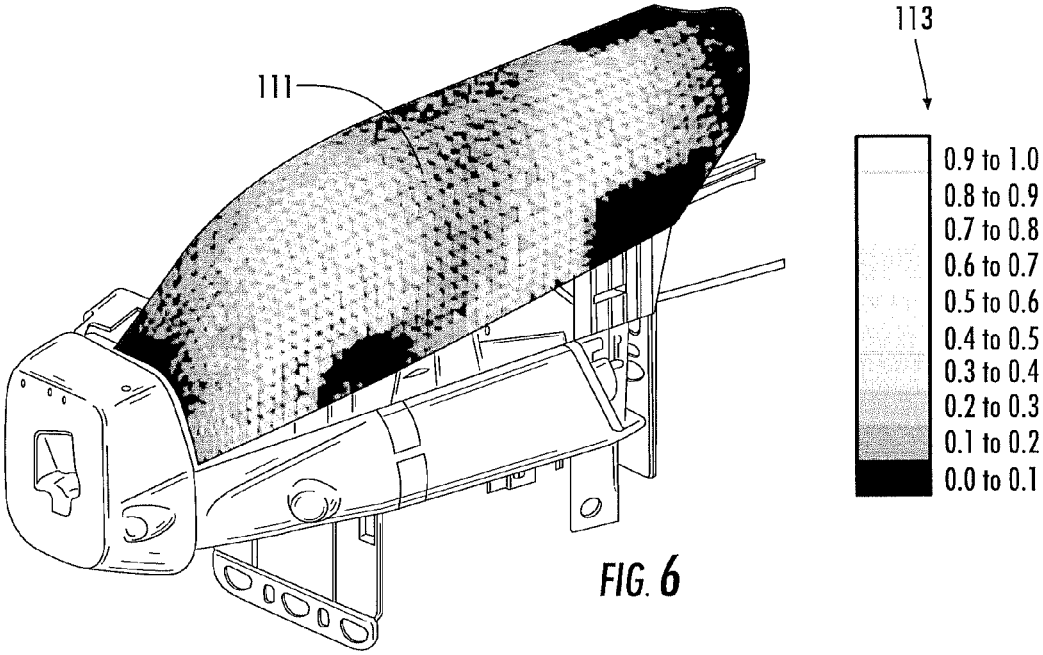
FIG. 6 shows an isometric view of probability of kill (Pk) data overlaid on the tetrahedral mesh of FIG. 5.

Referring to FIG. 6, integration of existing CAD geometry and Pk intensity mapped mesh elements 111 into the designers working environment provides a more productive framework for determining where armor is needed and for evaluating design constraints imposed by the existing structure. Mesh elements 111 are similar to planar elements 105, except overlaid onto complex CAD geometry. The location of individual mesh elements 111 can be dimensionally evaluated, and used to derive armor geometry. Also, by selecting various levels of Pk intensity 113 to derive potential armor shapes, multiple configurations can be developed with various levels of added protection.

Still referring to FIG. 6, meshed elements 111 and corresponding Pk intensities 113 provide a dataset from which the trade off between added protection versus added area or weight can be directly evaluated during step 213 of method 201. With the goal of maximizing efficiency, or maximizing protection with minimal added armor, only the most effective elements from the dataset are used as guidance for the armor design. If we think of these elements as building blocks, we would begin with the element 111 having the highest of Pk intensities 113. Then the element 111 having the next highest Pk intensity 113 is selected, and so on until a derived armor shape begins to emerge. If continued further, the less effective remaining elements that are included will provide diminished levels of added protection, and the efficiency will be reduced.

Figures 7, 8:
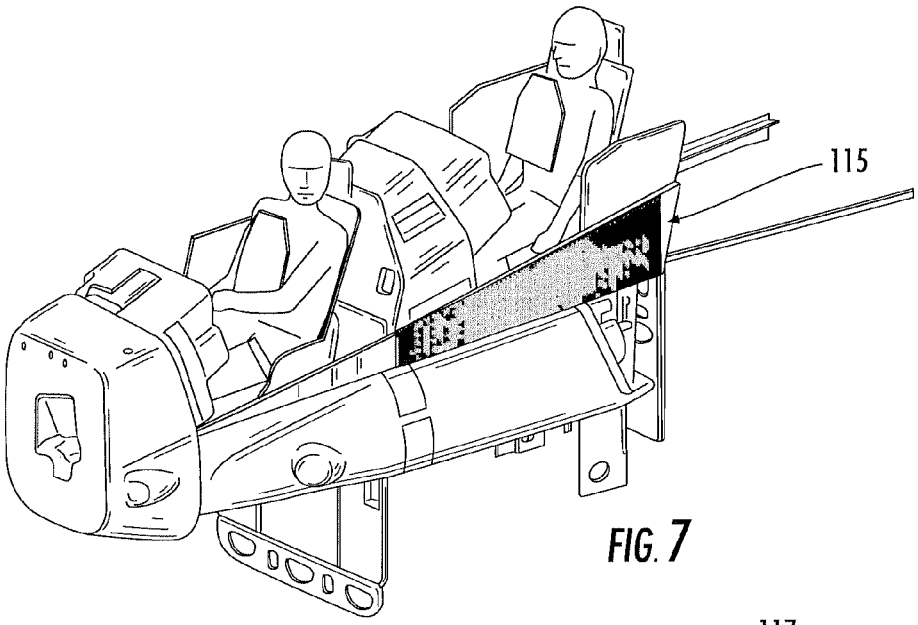
FIG. 7 shows an isometric view of the data from FIG. 6 overlaid onto an exterior skin of the air vehicle airframe.
FIG. 8 shows a table of data for sorting mesh elements.

Referring also to FIG. 7, the meshed elements 111 shown in FIG. 6 can be mathematically quantified and results plotted to provide further guidance to the designer as to how much armor should be integrated. This can be achieved by sorting mesh elements 111 from highest to lowest by Pk intensity 113, and by plotting a cumulative total of shot Pk values versus element area. As an example, the exterior skin of the air vehicle shown in FIG. 7 is evaluated in this fashion. This area is modeled as a multi-element tetrahedral mesh 115, and the resulting Pk Intensities are shaded for each element, as shown in FIG. 7.

Referring now also to FIG. 8, the mesh elements 115 are sorted by decreasing intensity, and the cumulative total of shot Pk values and element area is derived and shown below in dashed box 117 in FIG. 8. The data within dashed box 119 of FIG. 8 shows there are several elements 115 with a Pk sum of zero, meaning no shots are intersecting them. Since they offer no added protection, it is obvious they should not be considered in defining the actual armor geometry. Similar reasoning applies to other areas of low intensity. To quantify this, the normalized cumulative Pk sum as a function of cumulative area is plotted and is shown in FIG. 9.

Figure 9:
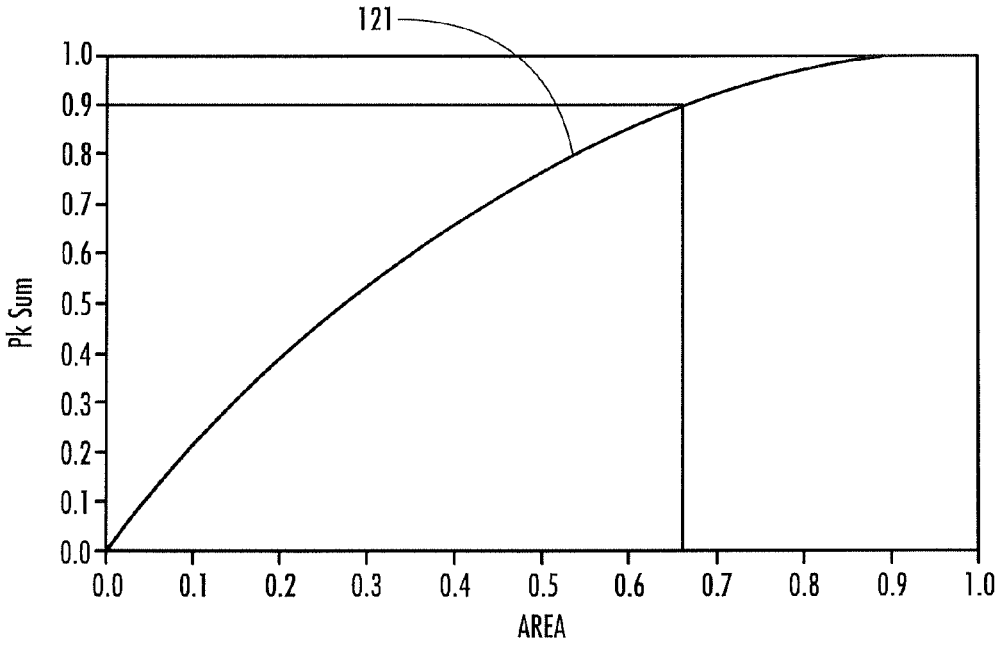
FIG. 9 shows a graph of normalized cumulative probability of kill (Pk) sum as a function of cumulative area.

Referring to FIG. 9, since the mesh elements were sorted from highest to lowest intensity, those with limited effect are represented by the upper or right hand portion of the plotted curve 121. The diminishing slope of the curve there indicates that these elements contribute less and less to the Pk sum or level of protection provided as their remaining area is included. This curve also shows the direct tradeoff between added protection and area. For this particular example, 90% of the total available protection could theoretically be achieved using about 66% of the total area considered.

Still referring to FIG. 9, it should be appreciated that the plot by itself is not adequate to determine the best or most optimum level of protection that could or should be implemented. Other factors, such as allowable weight, physical integration and impact to adjacent structure, and other concerns will limit the practical options available. In addition, the mesh elements contributing to or not contributing to any chosen level of protection can be readily distinguished and plotted with a keep/discard color or shading scheme to help derive potential armor geometries. To show this, we'll assume the 90% protection level and highlight the corresponding mesh elements as lightly shaded, as shown in FIG. 10.

Figure 10:
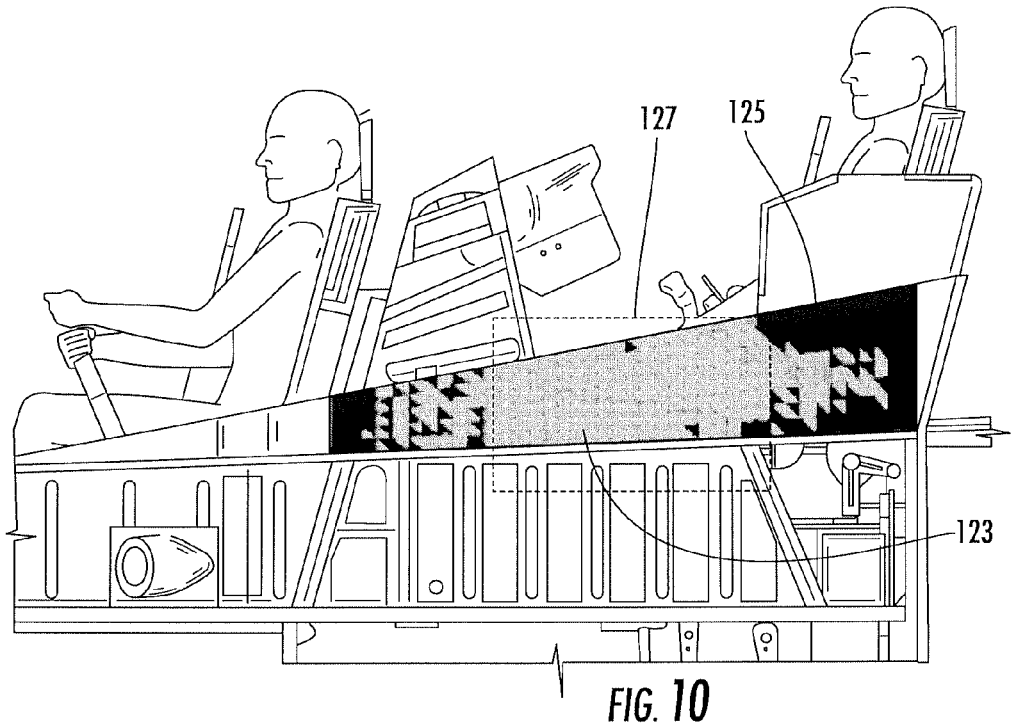
FIG. 10 shows a side view of shaded mesh elements in a keep/discard plotting scheme on the air vehicle airframe.
Figure 11:
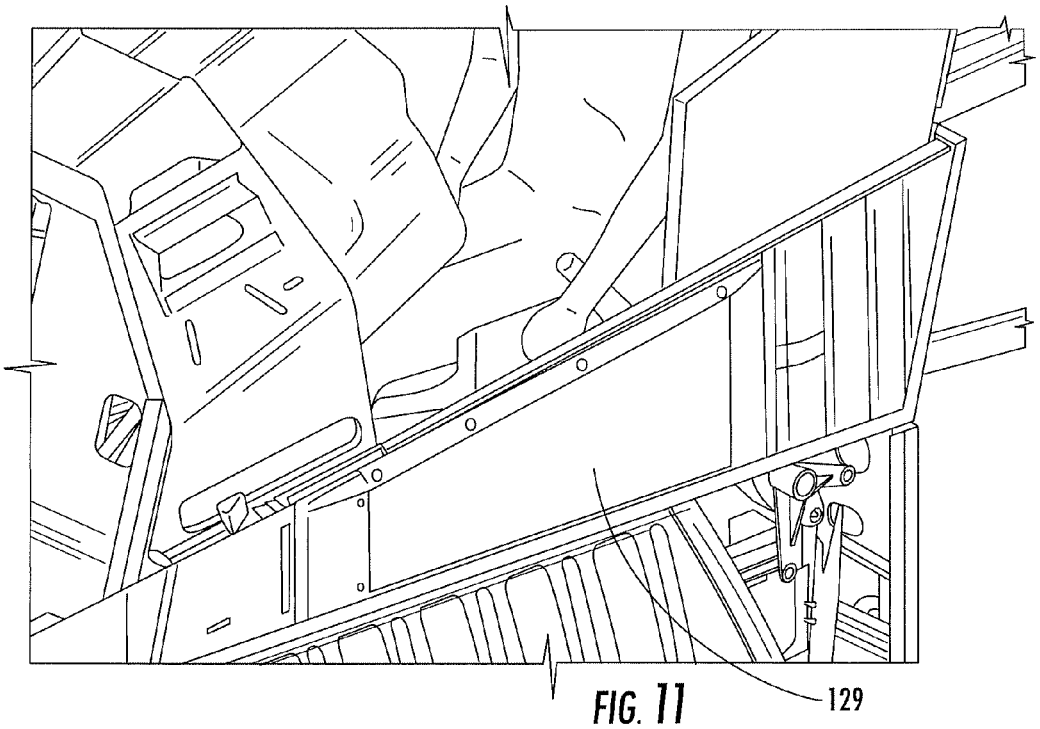
FIG. 11 shows an isometric view a derived armor solution according to the preferred embodiment of the present application.

Referring to FIGS. 10 and 11, the colored coded or lightly shaded mesh elements 123 would be used to derive armor geometry, and the color coded or darkly shaded mesh elements 125, would be ignored. It is obvious that the sparse distribution of lightly shaded elements in the forward and aft areas cannot be integrated as shown in a practical sense. However, the tightly grouped areas that are outlined by dashed box 127 does provide a basic template for deriving the efficient and practical design solution of armor 129, as shown in FIG. 11. The design of armor 129 represents the culmination, in step 213, of taking into account light shaded mesh elements 123 and darkly shaded mesh elements 125 within dashed box 127.

Additional optimization of armor can also be achieved by determining how thick armor needs to be based on angle and velocity of ballistic impact. In the past, the impact was usually assumed to be normal to the armor surface (zero obliquity), and with a velocity close to or equal velocity leavening the weapon (muzzle). Because of this, the armor would be sized in weight and thickness for a worst case condition, which may or may not be needed depending on location. This, in addition to improper or excessive placement, would lead to excessively heavy designs.

During the evaluation of Pk intensity, step 207, the angle of obliquity for each shotline 101 can be derived, and the worst case angle of impact for each area can be determined. For some areas, this angle will be close to or equal to zero, meaning the worst case impact will be normal to the armor surface, and greater thickness will be required. For other areas, where the angle is greater, the projectile will have a greater potential to be deflected rather than penetrate, and thinner material can be selected. Velocity or other ballistic parameters can also be evaluated to facilitate selection of thinner and less heavy materials.

The method 201 of the present application outlines a more direct and accurate means for achieving efficient armor placement and armor design. While referencing illustrative embodiments, this description is not intended to be construed in a limiting sense. Various modifications and other embodiments will be apparent to persons skilled in the art upon reference to the description.

The particular embodiments disclosed above are illustrative only, as the application may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the application. Accordingly, the protection sought herein is as set forth in the claims below. It is apparent that a method with significant advantages has been described and illustrated. Although the present application is shown in a limited number of forms, it is not limited to just these forms, but is amenable to various changes and modifications without departing from the spirit thereof.

The invention claimed is:

1. A method for designing protective armor for a vehicle, comprising:

for each of a plurality of elements, generating a dataset of shotlines, the shotlines including a plurality of shotlines through a respective element, at least two of the plurality of shotlines originating from different angles relative to the respective element;

computing a probability of kill value for each shotline associated with each element;

calculating a probability of kill intensity for each element and an angle of obliquity for each of the plurality of shotlines in order to determine the worst case angle of impact so as to minimize weight from the protective armor;

storing data associated with each dataset in a table, the data being sorted according to highest probability of kill intensity, and the data including a cumulative total probability of kill value for each dataset;

mapping the elements in a 3D CAD environment to visually depict the elements having the highest probability of kill intensity; and designing specific geometry of the protective armor taking into account the elements, the contribution of the elements to the cumulative total probability of kill value, and the probability of kill intensity of each element and a worst case angle of impact.

2. The method according to claim 1, wherein the mapping the elements in a 3D CAD environment involves applying a visual color scheme to the elements.

3. The method according to claim 1, wherein each shotline represents a shot trajectory that would be able to penetrate an airframe structure of the vehicle.

4. The method according to claim 1, wherein the computing the probability of kill value for each shotline involves giving each shotline a value between zero and one.

5. The method according to claim 1, wherein the computing the probability of kill value for each shotline involves taking into account a lethality of each shotline.

6. The method according to claim 1, wherein the calculating a probability of kill intensity for each element involves summing the probability of kill values and dividing by an area of the element.

7. The method according to claim 1, wherein the designing the protective armor taking into account the elements and the probability of kill intensity of each element involves configuring the shape of the armor be placed so as to include the elements having the highest kill intensity, as mapped in the 3D CAD environment.

8. The method according to claim 1, wherein the designing armor taking into account the elements and the probability of kill intensity of each element involves configuring the shape of the armor be placed so as to exclude the elements having the lowest kill intensity, as mapped in the 3D CAD environment.

9. The method according to claim 1, wherein the element is part of a mesh such that the mesh represents a complex CAD surface.

10. The method according to claim 1, wherein the designing the protective armor taking into account the elements and the probability of kill intensity of each element involves first incorporating the elements having the highest probability of kill intensity first, and then incorporating the elements having the next highest probability of kill intensity second.

11. The method according to claim 1, further comprising: determining how thick the armor needs to be based upon an angle between a shotline and the element.

12. The method according to claim 1, further comprising: determining how thick the armor needs to be based upon a predicted velocity of a ballistic impact at the element.

13. A method for designing protective armor for a vehicle, comprising:

generating a first dataset of a first group of shotlines, the shotlines passing through a first element, at least two of the shotlines originating from different angles relative to the first element;

computing a probability of kill value for each shotline associated with the first element;

calculating a probability of kill intensity for the first element;

generating a second dataset of a second group of shotlines, the shotlines passing through a second element;

computing a probability of kill value for each shotline associated with the second element;

calculating a probability of kill intensity for the second element;

storing data associated with each dataset in a table, the data being sorted according to highest probability of kill intensity, and the data including a cumulative total probability of kill value for each dataset;

mapping the first and second elements in a 3D CAD environment to visually depict the probability of kill intensity of both the first and second elements; and designing specific geometry of the protective armor taking into account the probability of kill intensity of both the first and second elements, the contribution of the elements to the cumulative total probability of kill value, and an angle of obliquity of each of the first group of shotlines and the second group of shotlines to determine a worst case angle of impact in order to minimize the protective armor.

14. The method according to claim 13, wherein the mapping the first and second elements in a 3D CAD environment involves applying a visual color scheme to the elements.

15. The method according to claim 13, wherein the first group of shotlines represents shot trajectories that would be able to penetrate an airframe structure of the vehicle, travel through the first element, and hit a target.

16. The method according to claim 13, wherein the computing the probability of kill value for each shotline associated with the first element involves taking into account a lethality of each shotline, the lethality being determined by a location of the shotline in relation to a target.

17. The method according to claim 16, wherein the target is a human occupant of vehicle.

* * * * *